US009364878B2

(12) United States Patent
Ritter et al.

(10) Patent No.: US 9,364,878 B2
(45) Date of Patent: Jun. 14, 2016

(54) METHOD, COMPUTER PROGRAM AND ROLLING MILL TRAIN FOR ROLLING A METAL STRIP

(75) Inventors: Andreas Ritter, Haiger (DE); Peter Sudau, Hilchenbach (DE); Markus Koch, Hilchenbach (DE)

(73) Assignee: SMS Group GmbH, Duesseldorf (DE)

( * ) Notice: Subject to any disclaimer, the term of this patent is extended or adjusted under 35 U.S.C. 154(b) by 0 days.

(21) Appl. No.: 14/124,396

(22) PCT Filed: Jun. 6, 2012

(86) PCT No.: PCT/EP2012/060698

§ 371 (c)(1),
(2), (4) Date: Mar. 6, 2014

(87) PCT Pub. No.: WO2012/168299

PCT Pub. Date: Dec. 13, 2012

(65) Prior Publication Data

US 2014/0298877 A1 Oct. 9, 2014

(30) Foreign Application Priority Data

Jun. 8, 2011 (DE) ..... 10 2011 106 327
Jun. 27, 2011 (DE) ..... 10 2011 078 150

(51) Int. Cl.
*B21B 13/00* (2006.01)
*B21B 37/16* (2006.01)
(Continued)

(52) U.S. Cl.
CPC ..... *B21B 13/00* (2013.01); *B21B 37/16* (2013.01); *B21B 37/48* (2013.01); *B21B 37/58* (2013.01); *B21B 2013/006* (2013.01); *B21B 2271/02* (2013.01); *B21B 2273/08* (2013.01)

(58) Field of Classification Search
CPC .. B21B 13/00; B21B 2013/006; B21B 37/16; B21B 37/165; B21B 37/48; B21B 37/58; B21B 1/24; B21B 1/26; B21B 1/28; B21B 1/30; B21B 1/32; B21B 1/36; B21B 37/007; B21B 37/18; B21B 37/20; B21B 34/24; B21B 37/26; B21B 37/60; B21B 37/62; B21B 2271/02; B21B 2273/08; B21B 2001/221; B21B 38/105; B21B 2261/04; B21B 2273/14; B21B 37/24
USPC ..... 72/226–227, 234, 365.2, 366.2, 379.2, 72/377–378, 6.2, 7.2–7.6, 8.1, 8.3, 8.4, 72/8.6, 8.8, 8.9, 9.2, 10.4, 10.7, 11.1, 11.2, 72/11.4, 11.5, 11.6, 11.8, 12.3, 12.5, 12.6, 72/12.7, 13.5, 13.7, 13.8, 15.4, 15.5, 199, 72/205, 229, 230, 231, 250
See application file for complete search history.

(56) References Cited

U.S. PATENT DOCUMENTS 3,762,195 A * 10/1973 Kitanosono ..... B21B 37/26 72/13.4
4,782,683 A * 11/1988 Tippins et al. ..... 72/229
(Continued)

FOREIGN PATENT DOCUMENTS

DE 33 17 635 A1 11/1984
DE 196 05 008 A1 7/1997
(Continued)

*Primary Examiner* — Peter DungBa Vo
*Assistant Examiner* — Joshua D Anderson
(74) *Attorney, Agent, or Firm* — Abelman, Frayne & Schwab

(57) ABSTRACT

The invention relates to a method, a computer program and a rolling mill train for cold rolling a metal strip (200). In order to achieve a shortening of undesired off-gauge lengths, the method according to the invention provides that the head (210) of the metal strip (200) already undergoes a thickness reduction at the first active rolling stand (n) in the rolling mill train, and then is transported on to the next rolling stand, in order to undergo a further thickness reduction there. The method according to the invention also provides for further reducing the initial pass thickness at the n-th rolling stand in accordance with the tensile stress that has built up in the meantime between the n+1-th and the n-th rolling stand.

8 Claims, 4 Drawing Sheets

(51) Int. Cl.
*B21B 37/48* (2006.01)
*B21B 37/58* (2006.01)

(56) References Cited

U.S. PATENT DOCUMENTS 4,793,169 A * 12/1988 Ginzburg ..... 72/240
5,435,164 A * 7/1995 Di Giusto et al. ..... 72/202
5,706,690 A * 1/1998 Connolly ..... B21B 1/36 72/229
6,227,021 B1 * 5/2001 Imanari ..... 72/12.3
7,980,109 B2 * 7/2011 Perret ..... 72/229
2010/0218576 A1 * 9/2010 Felkl ..... 72/6.2

FOREIGN PATENT DOCUMENTS

DE 10 2007 049 062 B 3/2009
JP 2002-126813 5/2002
RU 22 07 205 6/2003

* cited by examiner

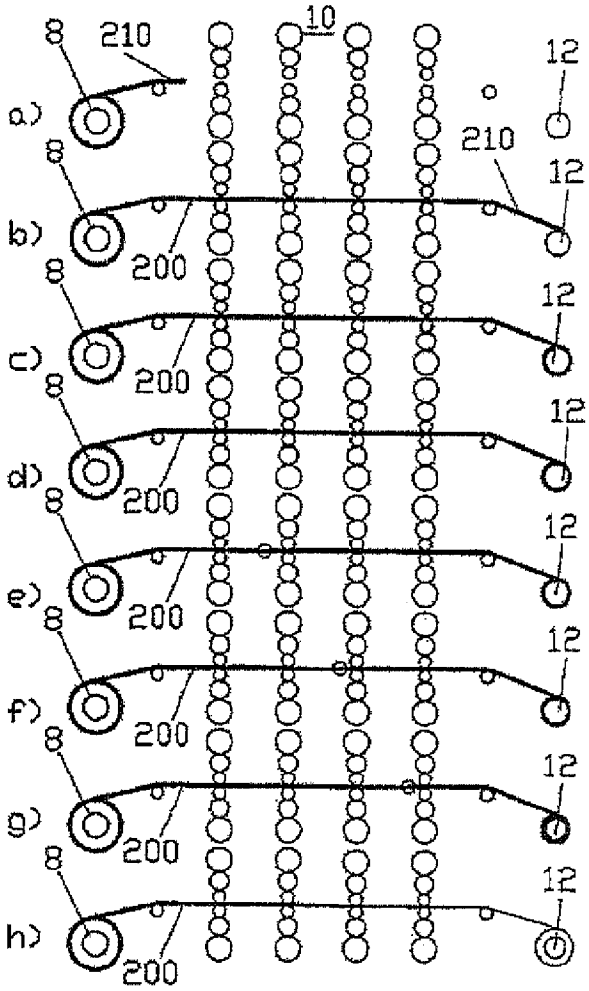

FIG. 3
PRIOR ART a) Strip head upstream of the 1st rolling stand b) Transport strip head for winding and starting the winding (roll gap opened)

c) Strip tension build-up at the winder d) Placement of the rollers e) Start of rolling beginning at the first rolling stand f) Passage of the thickness jump through the stands; successive start of the rolling at the individual stands as the thickness jump passes g) Rolling of the strip filet after reaching the target thickness at the last stand

METHOD, COMPUTER PROGRAM AND ROLLING MILL TRAIN FOR ROLLING A METAL STRIP

CROSS REFERENCE TO RELATED APPLICATIONS

This application is a national phase of PCT application No. PCT/EP2012/060698, filed Jun. 6, 2012, which claims priority to DE patent application No. 102011106327.0, filed Jun. 8, 2011, and DE patent application No. 102011078150.1, filed Jun. 27, 2011, all of which are incorporated herein by reference.

BACKGROUND OF THE INVENTION

1. Field of the Invention

The invention relates to a method, a computer program and a rolling mill train for rolling a metal strip. The rolling mill train comprises N active rolling stands arranged one after the other in the rolling direction.

2. Description of the Prior Art

In principle, such methods, computer programs and rolling stands are known in the prior art. Thus, from the International Publication WO 2009/049964 A1, a rolling mill train having at least two rolling stands is known, wherein the metal strip as it passes the rolling stand undergoes in each case a thickness reduction, since the roll gap of the rolling stand is set in each case to a predetermined initial pass thickness. The strip tension, in particular between two rolling stands, is monitored and if necessary it is set appropriately by means of appropriate setting means. Before the entry of the rolling material head into the roll gap, the latter is set in the vertical direction substantially to the inlet-side rolling material head thickness. After the entry of the rolling material head into the roll gap, the latter is closed to a predetermined value, and substantially simultaneously with the closing, the peripheral speed of the working rollers is changed, in particular increased, depending on the size of the roll gap.

In reference to FIG. 3, the method shown therein, which is the prior art, is explained in greater detail below, without referring to a printed document. The starting point is a four-stand tandem rolling mill train 10, wherein an unwinder 8 is arranged upstream of said mill train and a winder 12 is arranged downstream of said mill train. The method shown in FIG. 3 for cold rolling a metal strip 200 provides that first all the stands of the tandem mill train 10 are moved out, so that first the metal strip with the strip head 210 is passed without thickness reduction through the roll gap of the rolling stand to the winder 12, where it starts to be wound. As the winding starts, a tensile stress is generated in the metal strip between the winder 12 and the unwinder 8; see FIG. 3*c*).

After the build-up of the tensile stress, the working rollers of the rolling stands are first all placed onto the metal strip 200, see FIG. 3*d*), before the rolling at the first stand starts, in which the working rollers of said stand are closed to a roll gap having a predetermined initial pass thickness; see FIG. 3*e*). The thickness jump in the metal strip caused in this manner by the first rolling stand then passes successively through all the subsequent rolling stands of the tandem train 10. In the process, successive starting of the rolling on the individual stands occurs, as soon as said thickness jump passes the respective stand; see FIGS. 3*f* and 3*g*). The last rolling stand of the tandem train is preferably set to the desired target thickness for the metal strip.

There are two essential reasons for carrying out this method: On the one hand, the force and work demand during rolling without tension is considerably higher than with tension and, on the other hand, especially in the case of the small thicknesses used in cold rolling, the strip very rapidly becomes uneven, if the roll gap profile does not fit the incoming profile of the metal strip, and the rolling material thus undergoes different elongations over the strip width. A metal strip with unevenness can as a rule not start to be wound or rolled further in a subsequent stand, that is it cannot undergo a further reduction in thickness.

The disadvantage of this method is that, at the strip head, a considerable length of the metal strip does not have the desired thickness, and therefore has to be scrapped as off-gauge length. A similar situation occurs at the strip end. Here the back tension is missing as soon as the strip leaves the unwinder 8 or as soon as the last windings of the coil are in contact. In the conventional mode of operation, the roll gap of the individual rolling stands is also opened here, and this also results in off-gauge lengths.

SUMMARY OF THE INVENTION

Based on this prior art, the aim of the invention is to further develop a method, a computer program and a rolling mill train for cold rolling a metal strip so that the undesired off-gauge lengths are clearly shortened.

This aim is achieved by the method according to which the initial pass thickness of the n-th rolling stand of the rolling mill train in accordance with the tensile stress between the n-th and the n+1-th rolling stand is further reduced to a second predetermined initial pass thickness which is smaller than the first initial pass thickness of the n-th active rolling stand.

The term "active rolling stand" here denotes those rolling stands of the rolling mill train which, as a result of an appropriately small setting of their roll gap heights, contribute to a reduction of the thickness of the metal strip. Rolling stands with opened roll gap are not included among the active rolling stands in the sense of the invention; however, they can certainly be arranged between two active rolling stands within the rolling mill train. However, in this case, the rolling stands with opened roll gap are of no significance for the method according to the invention.

The inventive method basically includes the following steps:

a) setting of the roll gap of the n-th rolling stand (300) to a predetermined first initial pass thickness $D_{k,n}$ where k=1;

b) transporting the metal strip with the strip head (210) upstream of the n-th rolling stand (300);

c) initial pass of the metal strip to the first initial pass thickness $D_{k=1,n}$ in the n-th rolling stand;

d) setting the roll gap of the n+1-th rolling stand (300) to a predetermined first initial pass thickness $D_{k=1,n+1}$, which is smaller than the first initial pass thickness $D_{k=1,n}$ of the n-th active rolling stand;

e) transporting the metal strip to the n+1-th rolling stand;

f) initial pass of the metal strip to the first initial pass thickness $D_{k=1,n+1}$ of the n+1-th rolling stand;

g) building up a tensile stress in the metal strip between the n-th and the n+1-th rolling stand; and h) reducing the initial pass thickness of the n-th rolling stand in accordance with the tensile stress between the n-th and the n+1-th rolling stand to a second predetermined initial pass thickness $D_{2,n}$, which is smaller than the first initial pass thickness $D_{k=1,n}$ of the n-th active rolling stand.

The order of the steps of the method according to the invention does not necessarily have to be maintained strictly. Thus, the order of the steps a and b as well as of the steps d and e, respectively, can also be switched. This means that for the method according to the invention it does not matter whether the setting of the roll gap to a certain predetermined initial pass thickness occurs before the metal strip is transported to the respective rolling stand or after the metal strip or the strip head of the metal strip has already arrived at the inlet side of the rolling stand. However, in each case, the setting of the roll gap should be completed when the respective relevant site of the metal strip has arrived in the roll gap, after which site a thickness reduction is to take place.

The parameter n denotes the active rolling stands of the rolling mill train, which are arranged one after the other in the rolling direction.

The parameter k denotes the number of the changes that have been carried out, in particular the reductions of the initial pass thickness per rolling stand per rolling procedure.

The parameter x denotes the n rolling stands upstream of the rolling stand n.

The initial pass thicknesses are parametrized in the present description with the respective two parameters k and n. The initial pass thicknesses are typically functions of time; i.e., the changes of the initial pass thicknesses occur in a time-dependent manner.

The build-up of tensile stress in the present invention denotes an increase in the tensile stress.

The advantage of the method according to the present invention is that a built up and detected changed tensile stress in the metal strip between the n-th and n+1-th rolling stand is used in order to further reduce the initial pass thickness at the n-th active rolling stand. In this manner, the method according to the invention makes it possible to start cold rolling the metal strip, i.e., to start with the reduction of the thickness of the metal strip, already before the strip head reaches the winder and starts to be wound by the latter, in order to build up tensile stress. In other words: The build-up of the tensile stress, by the method according to the invention, is spatially and temporally moved upstream, away from the winder, to the first active rolling stand. In this manner a very clear reduction of the undesired off-gauge lengths is achieved.

A further reduction of the off-gauge lengths is achieved by repeating steps d) to h) in each case for n=n+1 until n=N−1. In other words: In a particularly advantageous manner, the method according to claim 1 is applied not only to two adjacent active rolling stands n and n+1 of the rolling mill train, but preferably to all the rolling stands or rolling stand pairs of the rolling mill train. In such a "horizontal" extension of the method according to the invention in the rolling direction, in the end almost all the rolling stands n where n≤n≤N−1 would each be set sequentially not only to a first, but also at least to one second further reduced predetermined initial pass thickness. As mentioned, this would lead to a further reduction of the undesired off-gauge lengths.

A further reduction of the off-gauge length can be achieved advantageously, after the build-up of the tensile stress between the n-th and the n+1-th rolling stand, by further reducing to a predetermined initial pass thickness not only the roll gap of the n-th rolling stand, but also the roll gap of at least one of the additional upstream rolling stands x, where 1≤x≤n−1. This is technically possible, because the change of the tensile stress between two rolling stands also has effects on the tensile stress of the metal strip between upstream rolling stands. In this manner it is possible to achieve that the initial pass thicknesses of individual rolling stands can be successively optimized increasingly more finely not only twice k=2, but more frequently k≥2, with a view to the final desired target thickness. In other words, using the described method according to the invention the initial pass thickness can already be successfully further reduced at the first rolling stands of the rolling mill train in the context of a quasi iteration process, i.e., a strong reduction in the thickness can be moved upstream to previous stands of the rolling mill train. In this manner, the off-gauge lengths are reduced even further.

Yet another reduction of the off-gauge lengths is achieved if the winder is used for building up a tensile stress between the winder and the N-th rolling stand of the rolling mill train, and the resulting generated tensile stress in turn is used for a further reduction of the initial pass thickness at the N-th rolling stand. The second predetermined initial pass thickness of the N-th rolling stand is smaller than the first initial pass thickness $D_{k-1,N}$ of the N-th rolling stand and smaller than the current initial pass thickness $D_{k,N-1}$ of the N−1-th rolling stand.

The respective settings or changes of the initial pass thicknesses of the individual rolling stands that have just been described are in each case calculated beforehand in a control device of the rolling mill train. Here, the calculation and the determination occur so that, at each rolling stand, taking into consideration the expected tensile stresses and the material stock properties of the metal strip as well as the technological limitations, the inlet thickness, and the desired target thickness, the maximum possible thickness reduction for the metal strip is set in each case. This leads to a further optimization of the method according to the invention and thus to an additional reduction of the undesired off-gauge lengths.

All the initial pass thicknesses k where 1≤k≤K of all n rolling stands of the rolling mill train are preferably adjusted with respect to each other so that the Kth predetermined initial pass thickness $D_{K,N}$ of the N-th rolling stand is the desired target thickness for the metal strip.

The method according to the invention preferably starts already at the head of the respective metal strip, the aim being again to reduce the off-gauge lengths. In contrast to the prior art, in the method according to the invention, the beginning of the strip thus does not first pass through the opened roll gaps of all the stands; instead, already at the time when the strip head passes through the rolling stand of the rolling mill train, an initial pass of the metal strip already occurs at the strip head.

The reduction of the initial pass thicknesses at the individual roller stands preferably does not occur discontinuously in the sense of a step function, but continuously, for example, in the form of a ramp over the course of time.

The reduction of the initial pass thicknesses at the n+1-th roller stand advantageously begins only when the thickness-reduced area, wedge-shaped for example, of the metal strip produced by one of the upstream roller stands reaches the n+1-th rolling stand.

The above-mentioned aim is achieved moreover by a computer program product whose program code is designed to control the rolling stands of the rolling mill train and to transport the metal strip in accordance with the claimed method.

Finally, the above-mentioned problem is solved moreover by a rolling mill train with a control device for carrying out the inventive method.

The advantages of the computer program product and of the rolling mill train correspond to the advantages mentioned above in reference to the claimed method.

FIG. 4 shows the general conditions of a pass schedule calculation for setting the roll gap of the working rollers in a rolling stand, as known from the prior art. Accordingly, the pass schedule calculation occurs taking into consideration general technical conditions, such as the tensions of the metal strip at the inlet and outlet sides, the inlet thickness, the desired target thickness as well as technological limitations.

In addition, the calculation of the maximum possible initial pass thicknesses takes place taking into consideration additionally the material of the metal strip to be rolled, the friction between the working rollers and the metal strip and taking into consideration additional stand data. From all the mentioned data, the roller model then calculates the required parameters for setting the working rollers, i.e., the rolling force, the rolling torque, the rolling bending, the shifting, the exit thickness as well as reinforcement factors of the technical control and in particular also the mentioned maximum possible initial pass thickness.

A total of four figures are added to the description.

BRIEF DESCRIPTION OF THE DRAWINGS

FIG. 3 *a*)-*h*) shows a cold rolling method according to the prior art.

DETAILED DESCRIPTION OF THE PREFERRED EMBODIMENT

Figure 1:
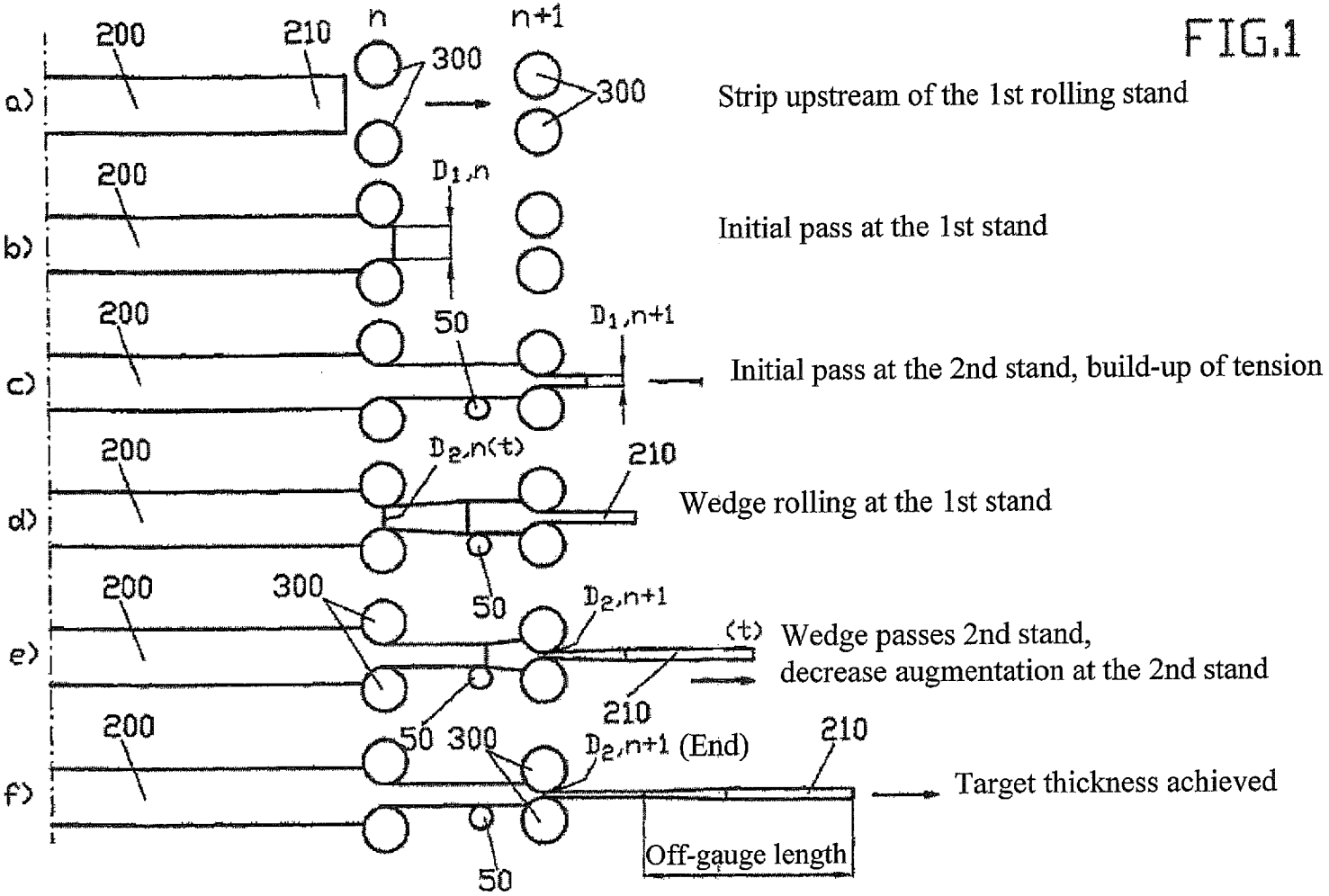
FIG. 1 *a*)-*f*) shows the method according to the invention without winder.
Figure 2:
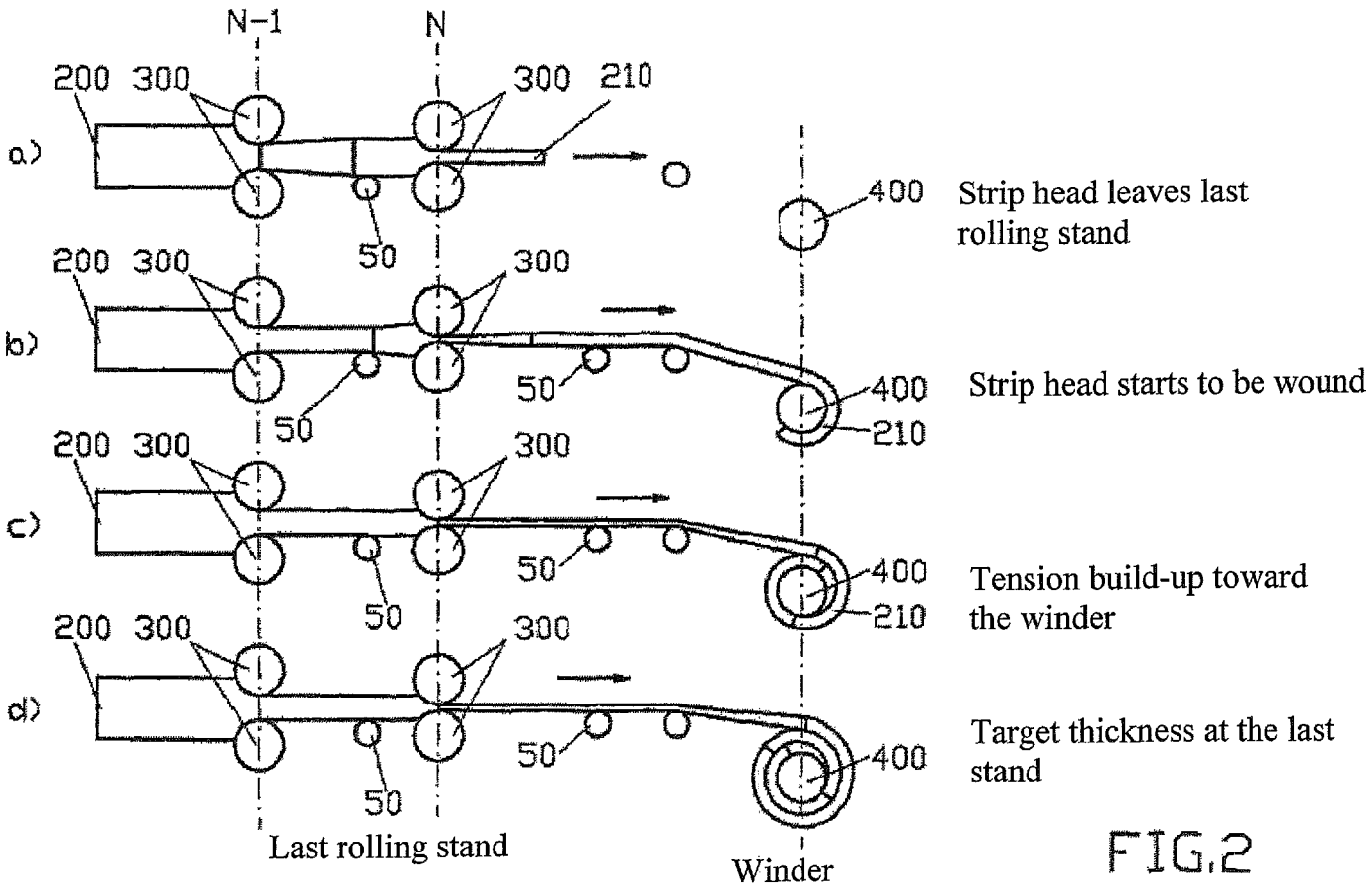
FIG. 2 *a*)-*d*) shows the method according to the invention with winder.
Figure 4:
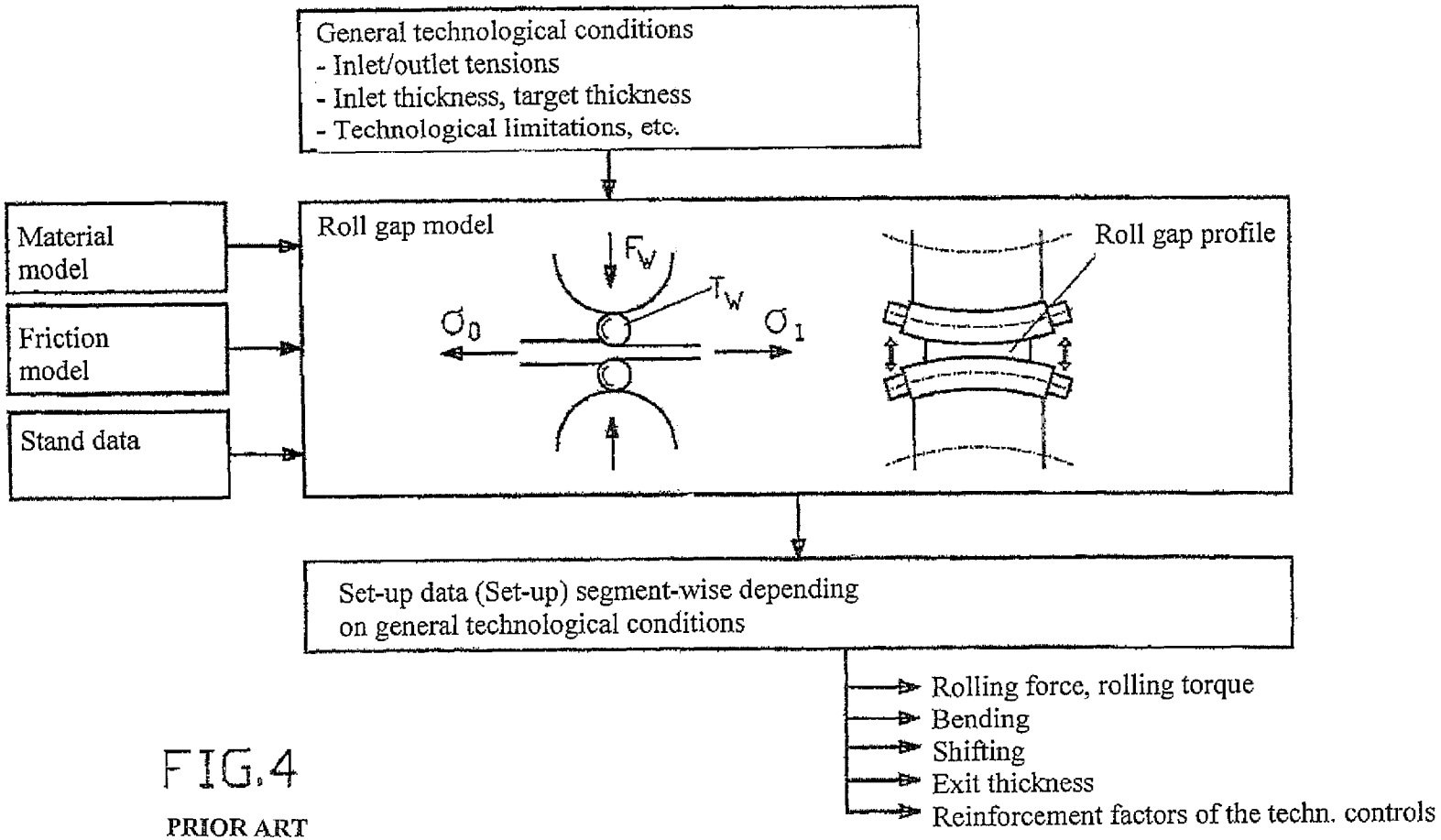
FIG. 4 PRIOR ART
FIG. 4 shows the general conditions for the pass schedule calculation according to the prior art.

The invention is described in further detail below in reference to FIGS. 1 and 2. In FIGS. 1 and 2, identical technical elements are denoted with identical reference numerals. Two circles or rollers arranged one above the other in pairs always denote a working roller pair with opened roll gap in FIGS. 1 and 2.

According to FIG. 1, the method according to the invention, in a first process step a), provides for setting the roll gap of the n-th rolling stand to a predetermined first initial pass thickness $D_{1,n}$, before the metal strip 200 passes with the strip head 210 through the roll gap of the n-th rolling stand; see FIG. 1*a*). The metal strip 200 is then moved on with its strip head 210 to the n-th rolling stand, where it, including its strip head 210, undergoes a reduction of its thickness to the first initial pass thickness $D_{1n}$, see FIG. 1*b*). The metal strip 200 is then transported further according to FIG. 1*c*) from the n-th rolling stand to the n+1-th rolling stand, where it undergoes an additional thickness reduction as a result of the working rollers of the n+1-th rolling stand, which are set to the first initial pass thickness $D_{1,n+1}$ where $D_{1,n+1}<D_{1,n}$. Then, a tensile stress is built up in the metal strip between the n+1-th and the n-th rolling stand. This tensile stress is measured using a tensile stress measuring device 50, for example, a tensile stress measuring roller. The method according to the invention furthermore provides that, subsequently, the initial pass thickness at the n-th rolling stand is further reduced to a second predetermined initial pass thickness $D_{2,n}$. The second initial pass thickness of the n-th rolling stand is smaller than its first initial pass thickness.

This reduction of the initial pass thickness at the n-th roller stand occurs preferably in the form of a ramp over time, which results in a wedge-shaped decrease of the thickness of the metal strip 200. The build-up of a tensile stress between the n+1-th and the n+2-th rolling stand can be used for the purpose of carrying out a second thickness reduction to a second predetermined initial pass thickness $D_{2,n+1}$ at the n+1-th rolling stand as well. This thickness reduction as well occurs preferably in the form of a ramp as a function of time. Ideally, the second predetermined initial pass thickness $D_{2,n+1}$ already corresponds to the desired target thickness for the metal strip, see FIG. 1*f*).

Depending on the total required thickness decrease, it can be necessary for the rolling mill train to have more than two active rolling stands 300. In this case, the described method according to the invention is preferably extended to all the rolling stands of the rolling mill train, i.e., in a quasi horizontal direction. In this case, i.e., in the case of more than two rolling stands in the rolling mill train, it is moreover advantageous, after the build-up of the tensile stress between the n-th and the n+1-th rolling stand, to also carry out a further reduction of the roll gap of least one additional upstream rolling stand to a respective predetermined initial pass thickness.

FIG. 2 shows how, in the end, the built-up tensile stress between the winder 400 and the last rolling stand of the rolling mill train, i.e., the N-th rolling stand, can also be used in order to achieve at the N-th rolling stand an additional thickness reduction, preferably to the desired target thickness. For this purpose, the strip head 210 first leaves the last N-th rolling stand 300 in the direction of the winder 400, where it starts being wound; see FIGS. 2*a*) and *b*). The start of winding leads to the build-up of tensile stress in the metal strip between the winder 400 and the N-th rolling stand 300, which is detected by the tensile stress measuring device 50; see FIG. 2*c*). This detected increase of the tension build-up between the winder 400 and the n-th rolling stand can then be used to further reduce the initial pass thickness at the N-th rolling stand, preferably to the desired target thickness. The last setting of the roll gap at the first rolling stand then occurs, if the resulting achieved reduction of the initial pass thickness of the metal strip is sufficient in order to roll to the desired target thickness at the outlet of the N-th rolling stand of the rolling mill train.

Advantageously, the method according to the invention is also used in a cold rolling mill train operated in reverse. After the first pass through the reversed mill train, the metal strip then generally has not yet reached the desired target thickness at stand N. The method is then repeated for at least one reverse run and resumed forward runs through the mill train until the desired target thickness has been reached.

The invention claimed is:

1. Method of cold rolling a metal strip (200) in a tandem rolling mill train with $1 \leq n \leq N$ wherein N corresponds to the total number of active rolling stands arranged one after the other in a rolling direction with N being two or more as desired, comprising the following steps:

a) setting a roll gap of an n-th active rolling stand (300) to a predetermined first initial pass thickness $D_{k,n}$ where k=1 so that the first initial pass thickness D of the roll gap is smaller than a thickness of a metal strip head (210) defining a beginning end of the metal strip; thereafter b) transporting the metal strip in the rolling direction toward the n-th active rolling stand with the strip head (210) facing the n-th rolling stand (300); thereafter c) continuously passing the metal strip including the metal strip head through the roll gap of the n-th active rolling stand to reduce the thickness of the metal strip and the metal strip head to the first initial pass thickness $D_{k=1,n}$ of the roll gap of the n-th active rolling stand;

d) setting a roll gap of the n+1-th active rolling stand (300) to a predetermined initial pass thickness $D_{k=1,n+1}$, which is smaller than the first initial pass thickness $D_{k=1,n}$ of the n-th active rolling stand;

e) transporting the metal strip in the rolling direction to the n+1-th active rolling stand with the strip head facing the n+1-th rolling stand; thereafter f) continuously passing the metal strip including the metal strip head through the roll gap of the n+1-th active rolling stand to reduce the thickness of the metal strip and the metal strip head to the initial pass thickness $D_{k=1,n+1}$ of the roll gap of the n+1-th active rolling stand;

g) building up a tensile stress in the metal strip between the n-th and the n+1-th active rolling stands after the strip head reaches the n+1-th rolling stand and before the strip head reaches a winder located downstream in the rolling direction of the N-th rolling stand;

characterized by:

h) reducing the initial pass thickness of the roll gap of the n-th active rolling stand in accordance with the built-up tensile stress between the n-th and the n+1-th active rolling stands, to a second predetermined initial pass thickness $D_{2,n}$ which is smaller than the first initial pass thickness $D_{k=1,n}$ of the n-th active rolling stand.

2. Method according to claim 1, characterized by repeating in each case the steps d) to h) for n=n+1 to n=N−1.

3. Method according to claim 2, characterized by:

further transporting the metal strip after passing the N-th rolling stand with the first initial pass thickness $D_{k=1,N}$ to a winding device;

winding the beginning of the strip of the metal strip on the winding device (400); and building up a tensile stress in the metal strip between the winding device and the N-th rolling stand; and reducing the initial pass thickness of the N-th rolling stand in accordance with the tensile stress between the N-th rolling stand and the winding device (400) to a second predetermined initial pass thickness $D_{2,N}$, which is smaller than the first initial pass thickness $D_{k=1,N}$ of the N-th rolling stand and smaller than the current initial pass thickness $D_{k,N-1}$ of the N−1-th rolling stand.

4. Method according to claim 1, characterized in that, after the build-up of the tensile stress between the n-th and the n+1-th rolling stands, the roll gap of at least one of the additional upstream rolling stands x, where 1≤x≤n−1, is also further reduced to a respective predetermined initial pass thickness.

5. Method according to claim 4, characterized in that the initial pass thicknesses and distribution of the initial pass thicknesses of all active rolling stands (300) of the rolling mill train for rolling the metal strip are calculated beforehand so that the k-th predetermined initial pass thickness $D_{k,N}$ of the N-th rolling stand is a desired target thickness for the metal strip.

6. Method according to claim 1, characterized in that the set initial pass thicknesses or roll gap heights for individual rolling stands (300) are calculated beforehand so that, taking into consideration expected tensile stresses and material properties of the metal strip, they allow in each case a maximum possible thickness reduction for the metal strip.

7. Method according to claim 1, characterized in that the reduction of the initial pass thicknesses of the roll gaps of the rolling stands occur continuously in a form of a ramp over the course of time.

8. Method according to claim 7, characterized in that the reduction of the initial pass thickness at the n+1-th rolling stand starts only when the thickness-reduced area of the metal strip, which is produced by a previous rolling stand, reaches the n+1-th rolling stand.

* * * * *